US006021756A

United States Patent [19]

Nakamura

[11] Patent Number: 6,021,756

[45] Date of Patent: Feb. 8, 2000

[54] ENGINE CONTROL SYSTEM FOR CONSTRUCTION MACHINE

[75] Inventor: Kazunori Nakamura, Ibaraki-ken, Japan

[73] Assignee: Hitachi Construction Machinery Co., Ltd., Tokyo, Japan

[21] Appl. No.: 09/083,432

[22] Filed: May 21, 1998

[30] Foreign Application Priority Data

May 27, 1997 [JP] Japan ..... 9-137073

[51] Int. Cl.[7] ..... F02D 41/40

[52] U.S. Cl. ..... 123/385; 123/501; 417/34

[58] Field of Search ..... 123/357, 500–501, 123/385, 386, 387; 417/34, 218

[56] References Cited

U.S. PATENT DOCUMENTS

| | | | |
|---|---|---|---|
| 5,468,126 | 11/1995 | Lukich | 123/385 |
| 5,680,842 | 10/1997 | Schmid | 123/501 |
| 5,765,995 | 6/1998 | Springer | 417/34 |
| 5,878,721 | 3/1999 | Nakamura | 123/385 |

FOREIGN PATENT DOCUMENTS 1-110839 4/1989 Japan .

OTHER PUBLICATIONS

Mechanization of Construction, 1996 Dec., No. 562, "Overview and Inspection/Servicing of Diesel Engine Adapted for Exhaust Gas Regulation", p. 63.

*Primary Examiner*—Thomas N. Moulis
*Attorney, Agent, or Firm*—Beall Law Offices

[57] ABSTRACT

The pump controller 40 determines pump load torques $T_{r1}$, $T_{r2}$ from tilting signals $\theta_1$, $\theta_2$ of hydraulic pumps 1, 2 and delivery pressure signals $P_{D1}$, $P_{D2}$ of the hydraulic pumps 1, 2 based on $T_{r1}=K\cdot\theta_1\cdot P_{D1}$ and $T_{r2}=K\cdot\theta_2\cdot P_{D2}$ (K: constant), and adds these pump load torques to provide a resulting value as an engine load torque signal T. Using the signal T, an engine controller 50 calculates fuel injecting timing depending on the engine load torque to control a timer actuator 55. This makes it possible to control the fuel injection timing with good response and high accuracy following load fluctuation, achieve optimum combustion, and prevent such a deterioration of exhaust gas as caused by the generation of $No_x$.

5 Claims, 9 Drawing Sheets

PROCESSING IN ENGINE CONTROLLER

PROCESSING FOR FUEL INJECTION TIMING

ENGINE CONTROL SYSTEM FOR CONSTRUCTION MACHINE

BACKGROUND OF THE INVENTION

1. Field of the Invention

The present invention relates to an engine control system for a construction machine, and more particularly to an engine control system for a construction machine such as a hydraulic excavator wherein a diesel engine having an electronic fuel injection device (electronic control governor) is used as a prime mover.

2. Description of the Related Art

A construction machine such as a hydraulic excavator generally includes at least one hydraulic pump for driving a plurality of actuators, and a diesel engine is used as a prime mover for rotatively driving the hydraulic pump. The diesel engine is controlled in injected fuel amount and fuel injection timing by a fuel injection device. Of them, the fuel injection timing has been conventionally determined by a mechanical timer mechanism depending on a revolution speed in most cases. With recent development of electronic control in the fuel injection device, however, the fuel injection timing has become freely controllable by an injection timing control actuator in addition to the injected fuel amount. As a result, good combustion is realized and engine performance is improved in a wide range by determining the optimum injection timing depending on a status variable such as the engine revolution.

For example, JP, A, 1-110839 discloses an internal combustion engine with a turbocharger wherein an intake pressure is detected by a pressure sensor at the time of quick acceleration to control the fuel injection timing such that the timing is advanced a predetermined angle to reduce the generation of black smoke when the detected intake pressure is not higher than a setting reference value, and is not advanced to prevent an abnormal rise of pressure in a cylinder when the detected intake pressure is not lower than the setting reference value. Also, FIGS. 1 and 2 of the Publication show that an engine load is input as one item of information to be reflected in control of the injection timing.

On the other hand, earlier timing of fuel injection provides a higher combustion temperature of fuel injected into a cylinder and hence better fuel efficiency (fuel consumption). As stated in, e.g., "Mechanization of Construction" (December 1996 No. 562), an article titled "Overview and Inspection/Servicing of Diesel Engine Adapted for Exhaust Gas Regulation (No. 2)", page 63, however, $NO_x$ meaning NO and $NO_2$ together, which are said to be responsible for photochemical smog, generally tends to be produced during operation at a high speed and under a high load. To make exhaust gas clean, therefore, a method of delaying the fuel injection timing in a high-speed and high-load condition, where $NO_x$ tends to be produced, is employed.

SUMMARY OF THE INVENTION

As mentioned above, the conventional electronic fuel injection device for a diesel engine has intended to realize combustion with a less amount of $No_x$, etc. by adjusting the fuel injection timing depending on an engine load. However, it has been hitherto general that the engine load is estimated from an engine revolution speed and an injected fuel amount, and is not accurately detected in a direct manner. This has raised the problem that the fuel injection timing cannot be controlled with high accuracy and there is a limit in effect of improving combustion.

Also, in the case of a diesel engine being used in a construction machine such as a hydraulic excavator, an object to be driven by the engine is a hydraulic pump. When a plurality of actuators are driven by a hydraulic pump, a delivery rate and a delivery pressure of the hydraulic pump are frequently changed and a load of the hydraulic pump, i.e., an engine load, is fluctuated. Accordingly, when injection timing control is performed by estimating the load based on the engine revolution speed and the injected fuel amount in such a diesel engine, in particular, the injection timing cannot be controlled with good response following fluctuation in load of the hydraulic pump and a sufficient improvement of combustion cannot be obtained.

An object of the present invention is to provide an engine control system for a construction machine with which, in a diesel engine for rotatively driving a hydraulic pump, combustion is improved and engine performance is enhanced by controlling the fuel injection timing with good response and high accuracy following load fluctuation.

(1) To achieve the above object, the present invention provides an engine control system for a construction machine comprising a diesel engine, at least one variable displacement hydraulic pump rotatively driven by the engine for driving a plurality of actuators, flow rate instruction means for instructing a delivery rate of the hydraulic pump, and an electronic fuel injection device for controlling an injected fuel amount in the engine, the electronic fuel injection device including a fuel injection timing control actuator for controlling fuel injection timing of the engine, wherein the engine control system comprises detecting means for detecting a status variable of the hydraulic pump, load calculating means for calculating a load of the hydraulic pump based on a value detected by the detecting means, and injection timing calculation control means for calculating target fuel injection timing of the engine based on a load of the hydraulic pump and operating the fuel injection timing control actuator.

Since the load calculating means calculates the load of the hydraulic pump based on the value detected by the detecting means, an accurate load imposed on the engine can be determined. Since the injection timing calculation control means calculates and controls the target fuel injection timing of the engine based on the load of the hydraulic pump, the fuel injection timing can be controlled with good accuracy. Also, even when the delivery rate and delivery pressure of the hydraulic pump are frequently changed and the load of the hydraulic pump (engine load) is fluctuated, the fuel injection timing can be controlled with good response following the load fluctuation. As a result, an improvement of combustion is achieved and engine performance is enhanced.

(2) In the above (1), preferably, the detecting means comprises means for detecting a delivery pressure of the hydraulic pump and means for detecting a tilting position of the hydraulic pump, and the load calculating means calculates the load of the hydraulic pump based on values detected by the delivery pressure detecting means and the tilting position detecting means.

With that feature, an accurate load imposed on the engine can be determined. Therefore, the fuel injection timing can be controlled with good response and high accuracy following the load fluctuation, as stated in the above (1).

(3) In the above (1), preferably, the detecting means may comprise means for detecting a delivery pressure of the hydraulic pump, and the load calculating means may calculate the load of the hydraulic pump based on a value detected by the delivery pressure detecting means and a target tilting corresponding to the delivery rate of the hydraulic pump instructed by the flow rate instructing means.

By calculating the load of the hydraulic pump by using the target tilting which represents a value before the delivery rate of the hydraulic pump is actually changed, response in injection timing control following fluctuation in the load of the hydraulic pump (engine load) is further improved, the injection timing control can be performed with higher accuracy, and a further improvement of combustion can be achieved.

(4) In the above (1), preferably, the injection timing calculation control means calculates the target fuel injection timing such that the fuel injecting timing of the engine is delayed as the load of the hydraulic pump increases.

By delaying the fuel injecting timing of the engine as the load of the hydraulic pump (engine load) increases, the generation of $No_x$ can be suppressed.

(5) In the above (1), preferably, the engine control system further comprises means for detecting a rotational speed of the engine, and the injection timing calculation control means calculates target fuel injection timing based on the rotational speed of the engine, and combines that target fuel injection timing and the target fuel injection timing calculated based on the load of the hydraulic pump with each other to determine target fuel injection timing used to operate the fuel injection timing control actuator.

With that feature, the above-stated fuel injection timing control based on the engine load can be performed in combination with fuel injection timing control based on the revolution speed.

DESCRIPTION OF THE PREFERRED EMBODIMENTS

Embodiments of the present invention will be described hereunder with reference to the drawings.

To begin with, a first embodiment of the present invention will be below described with reference to FIGS. 1 to 6.

Figure 1:
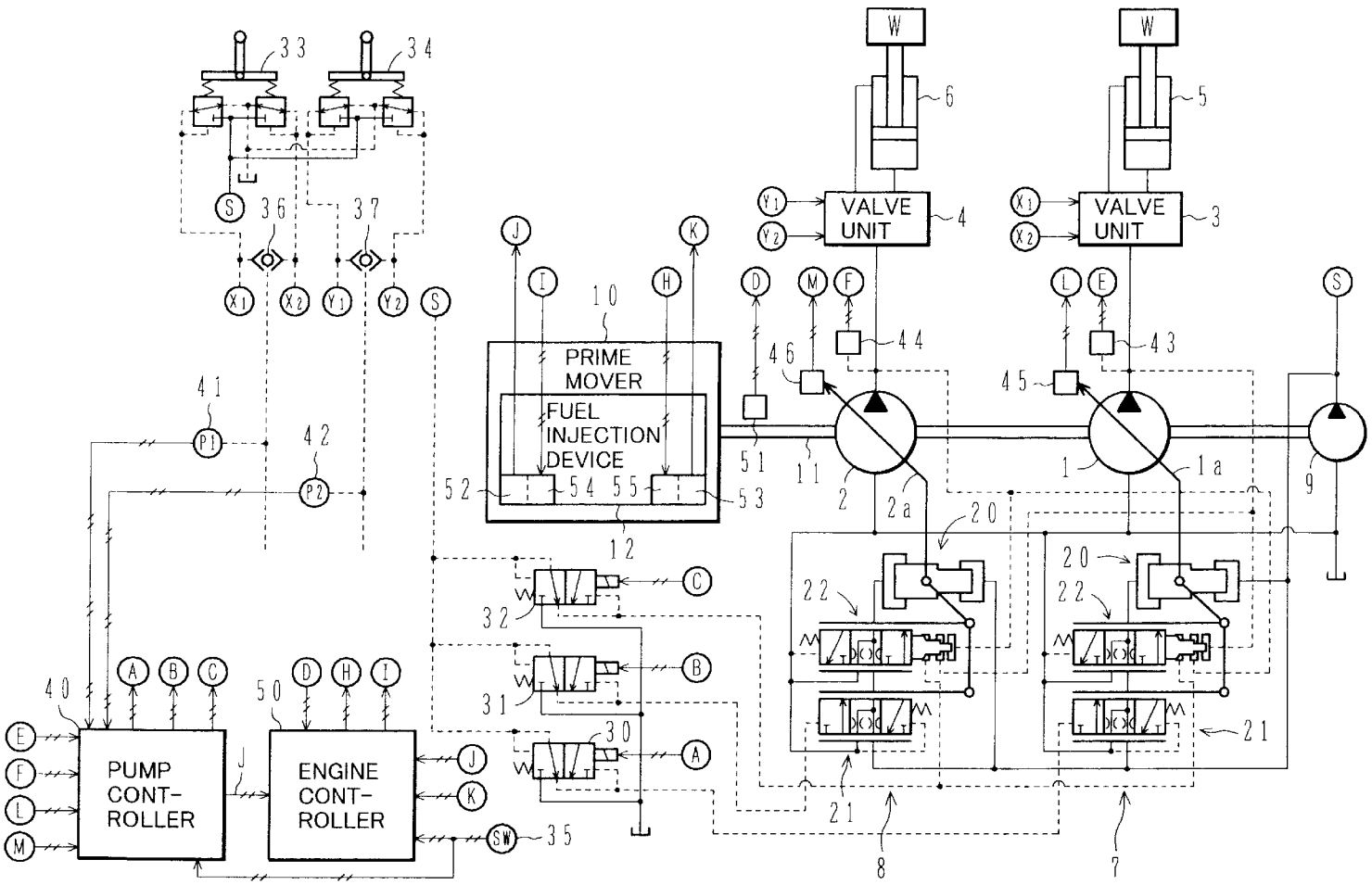
FIG. 1 is a diagram showing an entire configuration of an engine control system according to a first embodiment of the present invention along with a hydraulic circuit and a pump control system.

In FIG. 1, reference numerals 1 and 2 denote variable displacement hydraulic pumps. The hydraulic pumps 1, 2 are connected to actuators 5, 6 through valve units 3, 4, respectively, and the actuators 5, 6 are driven by hydraulic fluids delivered from the hydraulic pumps 1, 2. The actuators 5, 6 are hydraulic cylinders for, e.g., moving a boom, an arm, etc. which constitute a working front of a hydraulic excavator, and predetermined work is performed with driving of the actuators 5, 6. Commands for driving the actuators 5, 6 are applied from control lever units 33, 34 and the valve units 3, 4 are operated upon the control lever units 33, 34 being manipulated.

The hydraulic pumps 1, 2 are, by way of example, swash plate pumps wherein tiltings of swash plates 1*a*, 1*b* serving as displacement varying mechanisms are controlled by regulators 7, 8 to control respective pump delivery rates.

Denoted by 9 is a fixed displacement pilot pump serving as a pilot pressure generating source which generates a hydraulic pressure signal and a hydraulic fluid for control.

The hydraulic pumps 1, 2 and the pilot pump 9 are coupled to an output shaft 11 of a prime mover 10 and are rotatively driven by the prime mover 10. The prime mover 10 is a diesel engine and includes an electronic fuel injection device 12. A target revolution speed of the prime mover 10 is commanded by an accelerator operation input unit 35.

The regulators 7, 8 of the hydraulic pumps 1, 2 comprise, respectively, tilting actuators 20, 20, first servo valves 21, 21 for positive tilting control, and second servo valves 22, 22 for input torque limiting control. The servo valves 21, 22 control hydraulic fluid pressures acting on the tilting actuators 20 from the pilot pump 9.

Figure 2:
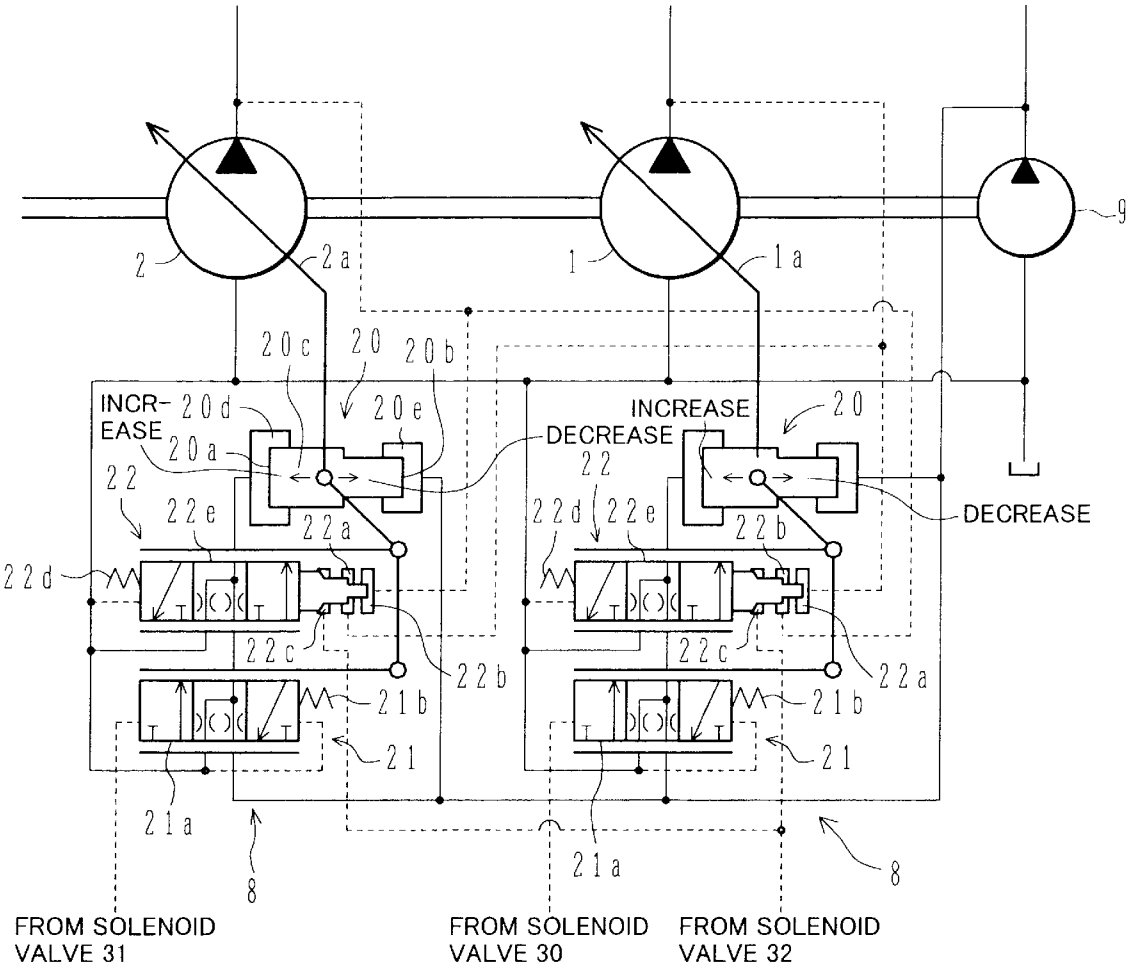
FIG. 2 is an enlarged view of a regulator section of a hydraulic pump.

The regulators 7, 8 of the hydraulic pumps 1, 2 are shown in FIG. 2 in an enlarged scale. The tilting actuators 20 each comprise an operating piston 20*c* provided with a large-diameter pressure bearing portion 20*a* and a small-diameter pressure bearing portion 20*b* at opposite ends thereof, and pressure bearing chambers 20*d*, 20*e* in which the pressure bearing portions 20*a*, 20*b* are positioned respectively. When pressures in both the pressure bearing chambers 20*d*, 20*e* are equal to each other, the operating piston 20*c* is moved to the right on the drawing due to an area difference between the pressure bearing portions 20*a*, 20*b*, whereupon the tilting of the swash plate 1*a* or 2*a* is diminished to reduce the pump delivery rate. When the pressure in the pressure bearing chamber 20*d* on the large-diameter side lowers, the operating piston 20*c* is moved to the left on the drawing, whereupon the tilting of the swash plate 1*a* or 2*a* is enlarged to increase the pump delivery rate. Further, the pressure bearing chamber 20*d* on the large-diameter side is connected to a delivery line of the pilot pump 9 through the first and second servo valves 21, 22, whereas the pressure bearing chamber 20*e* on the small-diameter side is directly connected to the delivery line of the pilot pump 9.

The first servo valves 21 for positive tilting control are each a valve operated by a control pressure from a solenoid control valve 30 or 31. When the control pressure is high, a valve body 21*a* is moved to the right on the drawing, causing a pilot pressure from the pilot pump 9 to be transmitted to the pressure bearing chamber 20*d* without being reduced, whereby the delivery rate of the hydraulic pump 1 or 2 is reduced. As the control pressure lowers, the valve body 21*a* is moved to the left on the drawing by force of a spring 21*b*, causing the pilot pressure from the pilot pump 9 to be transmitted to the pressure bearing chamber 20*d* after being reduced, whereby the delivery rate of the hydraulic pump 1 or 2 is increased.

The second servo valves 22 for input torque limiting control are each a valve operated by delivery pressures of the hydraulic pumps 1 and 2 and a control pressure from a solenoid control valve 32. The delivery pressures of the hydraulic pumps 1 and 2 and the control pressure from the solenoid control valve 32 are introduced respectively to pressure bearing chambers 22*a*, 22*b*, 22*c* of operation drivers. When the sum of hydraulic pressure forces given by the delivery pressures of the hydraulic pumps 1 and 2 is lower than a setting value which is determined by a difference between resilient force of a spring 22*d* and hydraulic pressure force given by the control pressure introduced to the pressure bearing chamber 22*c*, a valve body 22*e* is moved to the right on the drawing, causing the pilot pressure from the pilot pump 9 to be transmitted to the pressure bearing chamber 20*d* after being reduced, whereby the delivery rate of the hydraulic pump 1 or 2 is increased. As the sum of hydraulic pressure forces given by the delivery pressures of the hydraulic pumps 1 and 2 rises over the setting value, the valve body 22*e* is moved to the left on the drawing, causing the pilot pressure from the pilot pump 9 to be transmitted to the pressure bearing chamber 20*d* without being reduced, whereby the delivery rate of the hydraulic pump 1 or 2 is reduced. Further, when the control pressure from the solenoid control valve 32 is low, the setting value is increased so that the delivery rate of the hydraulic pump 1 or 2 starts reducing from a relatively high delivery pressure of the hydraulic pump 1 or 2, and as the control pressure from the solenoid control valve 32 rises, the setting value is decreased so that the delivery rate of the hydraulic pump 1 or 2 starts reducing from a relatively low delivery pressure of the hydraulic pump 1 or 2.

The solenoid control valves 30, 31 are operated (as described later) to maximize the control pressures output from them when the control lever units 33, 34 are in neutral positions, and when the control lever units 33, 34 are manipulated, to lower the control pressures output from them with an increase in respective input amounts by which the control lever units 33, 34 are manipulated. The solenoid control valve 32 is operated (as described later) to lower the control pressure output from it as the target revolution speed indicated by an accelerator signal output from the accelerator operation input unit 35.

As explained above, as the input amounts of the control lever units 33, 34 increase, the tiltings of the hydraulic pumps 1, 2 are controlled so that the delivery rates of the hydraulic pumps 1, 2 are increased to provide the delivery rates adapted for demanded flow rates of the valve units 3, 4. In addition, as the delivery pressures of the hydraulic pumps 1, 2 rise, or as the target revolution speed input from the accelerator operation input unit 35 lowers, the tiltings of the hydraulic pumps 1, 2 are controlled so that maximum values of the delivery rates of the hydraulic pumps 1, 2 are limited to smaller values to keep the load of the hydraulic pump 1 from exceeding the output torque of the prime mover 10.

Returning to FIG. 1, reference numeral 40 denotes a pump controller and 50 an engine controller.

The pump controller 40 receives detection signals from pressure sensors 41, 42, 43, 44 and position sensors 45, 46, as well as the accelerator signal from the accelerator operation input unit 35. After executing predetermined processing, the pump controller 40 outputs control currents to the solenoid control valves 30, 31, 32 and an engine load torque signal to the engine controller 50.

The control lever units 33, 34 are of the hydraulic pilot type producing and outputting a pilot pressure as an operation signal. Shuttle valves 36, 37 for detecting the pilot pressures are provided in respective pilot circuits of the control lever units 33, 34, and the pressure sensors 41, 42 electrically detect the respective pilot pressures detected by shuttle valves 36, 37. Also, the pressure sensors 43, 44 electrically detect the respective delivery pressures of the hydraulic pumps 1, 2, and the position sensors 45, 46 electrically detect the respective tiltings of the swash plates 1*a*, 2*a* of the hydraulic pumps 1, 2.

The engine controller 50 receives not only the accelerator signal from the accelerator operation input unit 35 and the engine load torque signal from the pump controller 40, but also detection signals from a revolution speed sensor 51, a link position sensor 52 and a lead angle sensor 53. After executing predetermined processing, the engine controller 50 outputs control currents to an governor actuator 54 and a timer actuator 55. The revolution speed sensor 51 detects the revolution speed of the engine 10.

Figure 3:
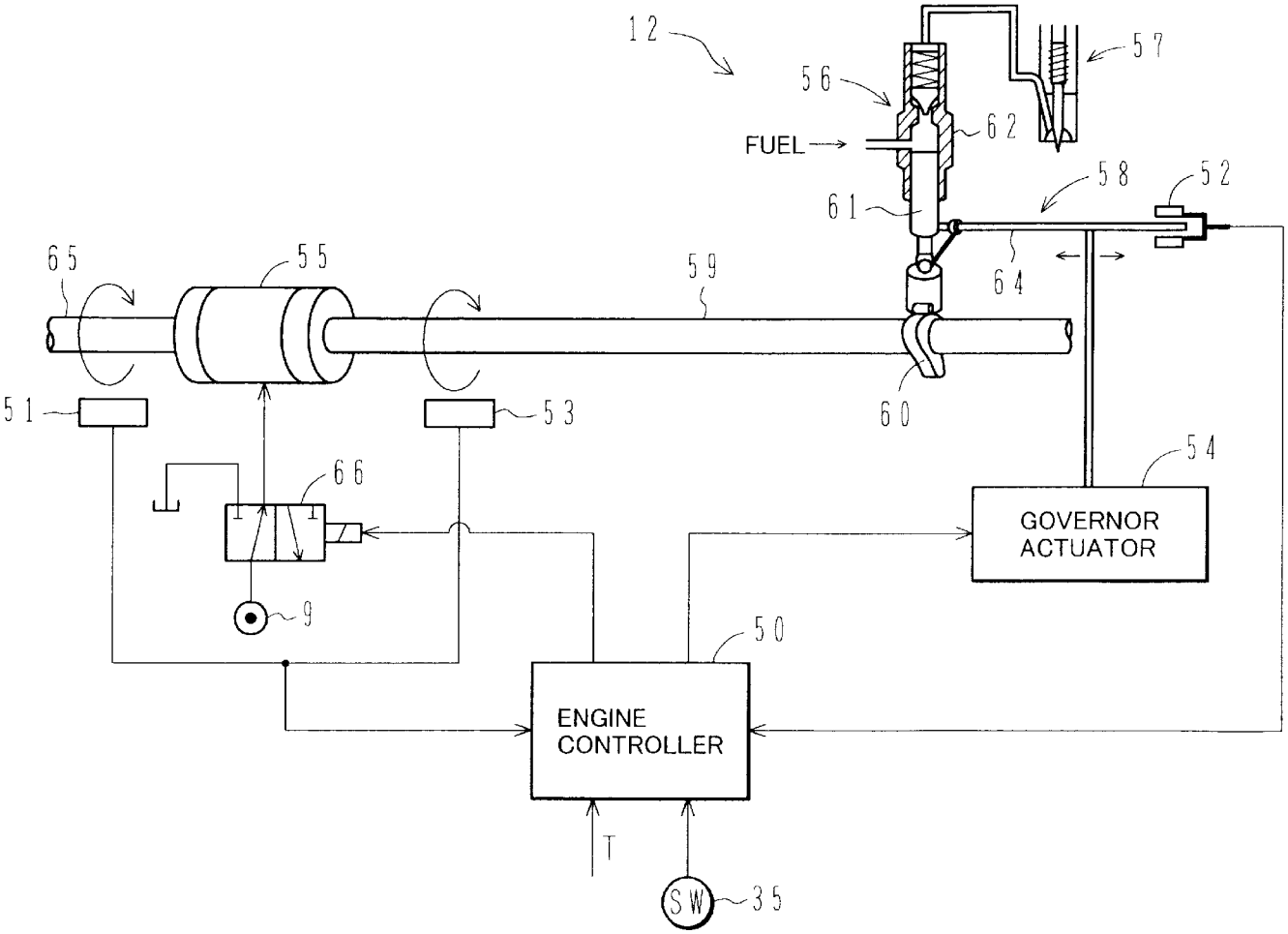
FIG. 3 is a diagram showing a schematic configuration of an electronic fuel injection device.

FIG. 3 shows an outline of the electronic fuel injection device 12 and a control system for it. In FIG. 3, the electronic fuel injection device 12 comprises an injection pump 56, an injection nozzle 57 and a governor mechanism 58 for each cylinder of the engine 10. The injection pump 56 comprises a plunger 61 and a plunger barrel 62 within which the plunger 61 is vertically movable. When a cam shaft 59 is rotated, a cam 60 mounted on the cam shaft 59 pushes up the plunger 61 and then pressurize fuel upon the rotation. The pressurized fuel is delivered to a nozzle 57 and injected into the engine cylinder. The cam shaft 59 is rotated in association with a crankshaft of the engine 10.

Also, the governor mechanism 58 comprises the governor actuator 54 and a link mechanism 64 of which position is controlled by the governor actuator 54. The link mechanism 64 rotates the plunger 61 to change the relationship between a thread lead of the plunger 61 and a fuel intake port formed in the plunger barrel 62, whereby an effective compression stroke of the plunger 61 is changed to adjust the injected fuel amount. The link position sensor 52 is provided in the link mechanism to detect the link position. The governor actuator 54 is, e.g., an electromagnetic solenoid.

Further, the electronic fuel injection device 12 includes the timer actuator 55 which advances a lead angle of the cam shaft 59 with respect to rotation of a shaft 65 coupled to the crankshaft for phase adjustment to adjust the fuel injection timing. Because of necessity of transmitting a drive torque to the injection pump 56, the timer actuator 55 is required to produce large force enough for the phase adjustment. For that reason, the timer actuator 55 includes a hydraulic actuator built in it and is provided with a solenoid control valve 66 for converting the control current from the engine controller 50 into a hydraulic pressure signal and advancing the lead angle of the cam shaft 59 in a hydraulic manner. The revolution speed sensor 51 is provided to detect a revolution speed of the shaft 65 and the lead angle sensor 53 is provided to detect a revolution speed of the cam shaft 69.

Figure 4:
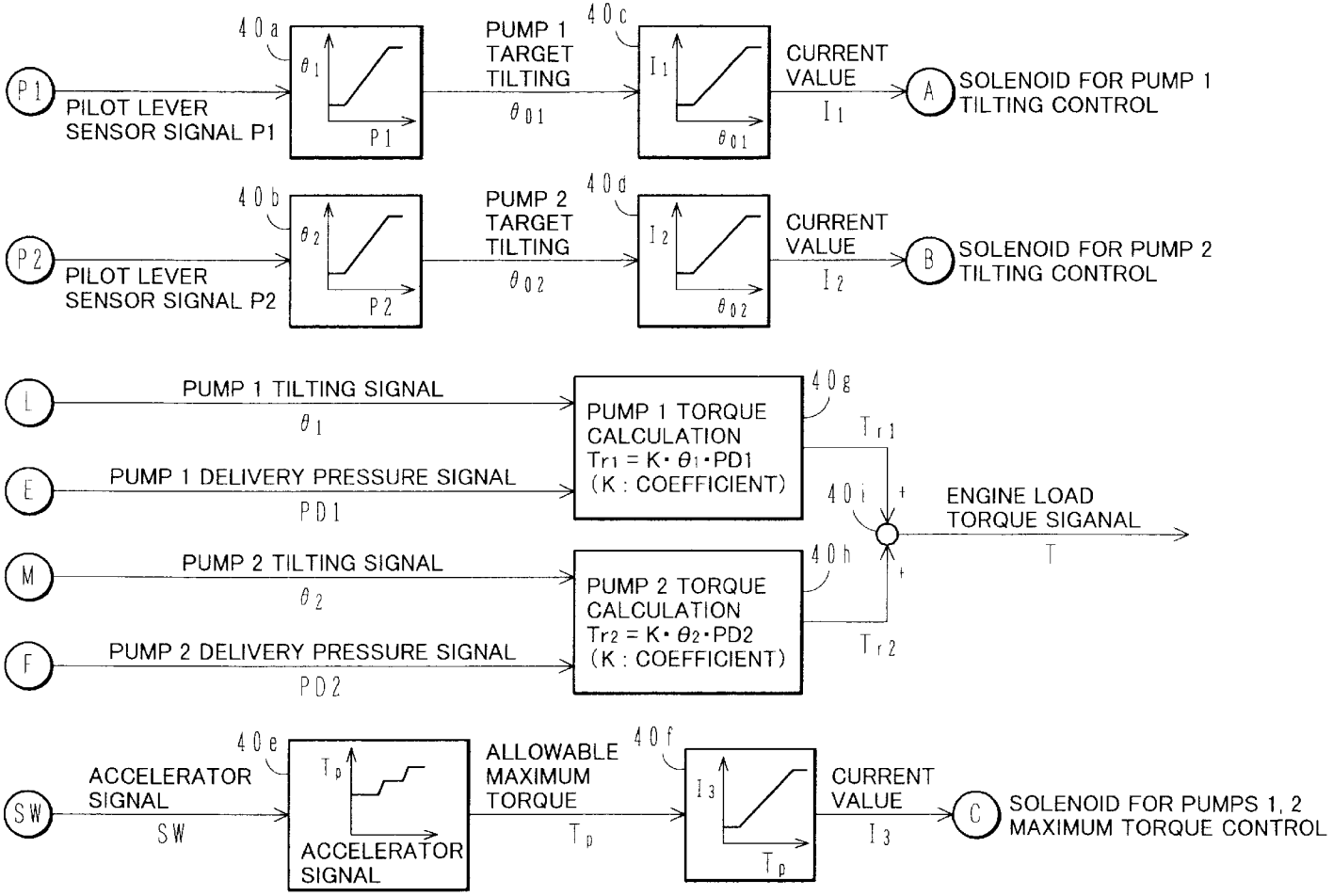
FIG. 4 is a functional block diagram showing a sequence of processing steps in a pump controller.

FIG. 4 shows a sequence of processing steps in the pump controller 40 in the form of a functional block diagram. In FIG. 4, the detection signals (pilot lever sensor signals P1 and P2) from the pressure sensors 41, 42 are converted into target tiltings $\theta_{01}$, $\theta_{02}$ of the hydraulic pumps 1, 2 in a target tilting calculation blocks 40*a*, 40*b* and then converted into current values $I_1$, $I_2$ in current value calculation blocks 40*c*, 40*d*. Control currents corresponding to the current values $I_1$, $I_2$ are output to the solenoid control valves 30, 31.

Here, the relationships between the pilot pressures represented by the sensor signals P1, P2 and the target tiltings $\theta_{01}$, $\theta_{02}$ in the blocks 40*a*, 40*b* are set such that as the pilot pressures rise, the target tiltings $\theta_{01}$, $\theta_{02}$ increase. The relationships between the target tiltings $\theta_{01}$, $\theta_{02}$ and the current values $I_1$, $I_2$ in the blocks 40*c*, 40*d* are set such that as the target tiltings $\theta_{01}$, $\theta_{02}$ increase, the current values $I_1$, $I_2$ increase. With those settings, as mentioned above, the solenoid control valves 30, 31 are operated to maximize the control pressures output from them when the control lever units 33, 34 are in neutral positions, and when the control lever units 33, 34 are manipulated, to lower the control pressures output from them with an increase in respective input amounts by which the control lever units 33, 34 are manipulated.

Also, the accelerator signal from the accelerator operation input unit 35 is converted into an allowable maximum torque $T_p$ in a maximum torque calculation block 40*e* and then converted into a current value $I_3$ in a current value converter 40*f*. A control current corresponding to the current value $I_3$ is output to the solenoid control valve 32. The accelerator operation input unit 35 is manipulated by an operator, and the accelerator signal is selected depending on conditions where the operator is going to use the machine, thereby commanding the target revolution speed.

Here, the relationship between the accelerator signal and the allowable maximum torque $T_p$ in the block 40*e* is set such that the allowable maximum torque $T_p$ increases as the target revolution speed represented by the accelerator signal becomes higher. The relationship between the allowable maximum torque $T_p$ and the current value $I_3$ in the block 40*f* is set such that the allowable maximum torque $T_p$ becomes larger as the current value increases. With those settings, as mentioned above, the solenoid control valve 32 is operated to lower the control pressure output from it as the target revolution speed represented by the accelerator signal from the accelerator operation input unit 35 becomes higher.

Further, the detection signal from the position sensor 45 (tilting signal $\theta_1$ of the hydraulic pump 1) and the detection signal from the pressure sensor 43 (delivery pressure signal $P_{D1}$ of the hydraulic pump 1) are input to a torque calculation block 40*g*, while the detection signal from the position sensor 46 (tilting signal $\theta_2$ of the hydraulic pump 2) and the detection signal from the pressure sensor 44 (delivery pressure signal $P_{D2}$ of the hydraulic pump 2) are input to a torque calculation block 40*h*. Load torques $T_{r1}$, $T_{r2}$ of the hydraulic pumps 1, 2 are calculated in those blocks 40*g*, 40*h* from the following formulae:

$$T_{r1}=K\cdot\theta_1\cdot P_{D1}$$

$$T_{r2}=K\cdot\theta_2 P_{D2} \text{ (}K\text{: constant)}$$

The load torques $T_{r1}$, $T_{r2}$ are added in an adder 40*i* to determine a total of the load torques of the hydraulic pumps 1, 2. The total of the load torques is output as an engine load torque signal T to the engine controller 50.

Figure 5:
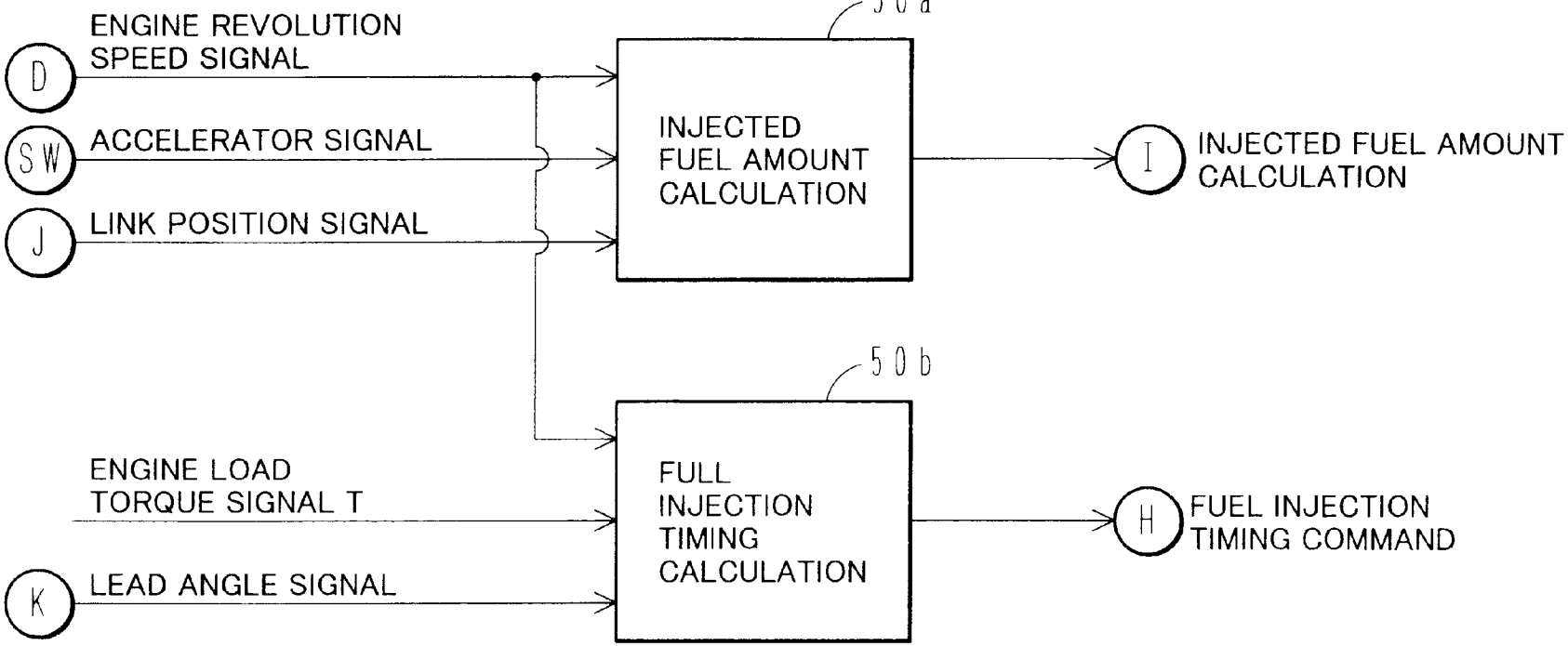
FIG. 5 is a functional block diagram showing a sequence of processing steps in an engine controller.

FIG. 5 shows a sequence of processing steps in the engine controller 50 in the form of a functional block diagram. In FIG. 5, the accelerator signal from the accelerator operation input unit 35, the detection signal from the revolution speed sensor 51 (engine revolution speed signal), and the detection signal from the link position sensor 52 (link position signal) are converted into an injected fuel amount command in an injected fuel amount calculation block 50*a*. A control current corresponding to the injected fuel amount command is output to the governor actuator 54. The processing executed in the injected fuel amount calculation block 50*a* is known. More specifically, when one of the target revolution speed represented by the accelerator signal and the engine revolution speed detected by the revolution speed sensor 52 is changed such that a revolution speed deviation ΔN resulted from subtracting the detected revolution speed from the target revolution speed increases in the positive direction, the link position of the link mechanism 64 is adjusted to increase the injected fuel amount. On the other hand, when the revolution speed deviation ΔN decreases in the negative direction, the link position of the link mechanism 64 is adjusted to reduce the injected fuel amount. The link position signal is used for feedback control.

Further, the detection signal from the revolution speed sensor 51 (engine revolution speed signal), the engine load torque signal T from the pump controller 40, and the detection signal from the lead angle sensor 53 (lead angle signal) are converted into a fuel injection timing command in a fuel injection timing calculation block 50*b*. A control current corresponding to the fuel injection timing command is output to the solenoid control valve 66 of the timer actuator 55.

Figure 6:
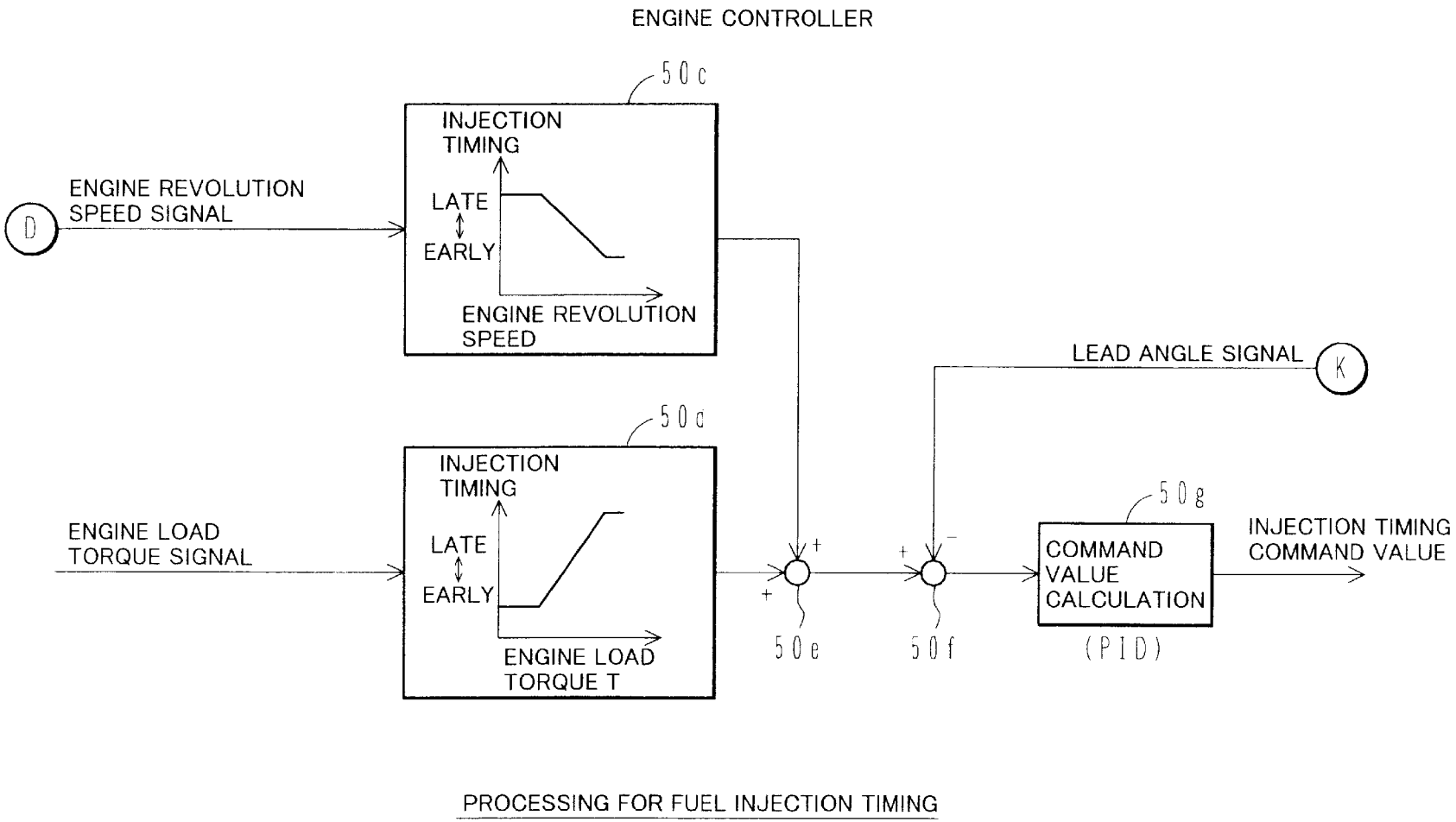
FIG. 6 is a functional block diagram showing a sequence of processing steps in a fuel injection timing calculation block in the engine controller.

FIG. 6 shows a sequence of processing steps in the fuel injection timing calculation block 50*b* in more detail. In FIG. 6, the detection signal from the revolution speed sensor 51 (engine revolution speed signal) is input to a first injection timing calculation block 50*c* where the injection timing depending on the engine revolution speed is calculated.

In the first injection timing calculation block 50*c*, the injection timing is calculated based on the well-known concept. More specifically, the first injection timing calculation block 50*c* has set therein beforehand the relationship between the engine revolution speed and the injection timing with which when the engine revolution speed is low, the injection timing is relatively delayed with respect to the engine revolution, and as the engine revolution speed rises, the injection timing is advanced, namely set to an earlier point in time. The injection timing is calculated from that relationship.

The engine load torque signal T from the pump controller 40 is input to a second injection timing calculation block 50*d* where the injection timing depending on the engine load torque is calculated.

Meanwhile, it is known that earlier timing of fuel injection provides a higher combustion temperature of fuel injected into a cylinder and hence better fuel efficiency (fuel consumption). Therefore, the fuel injection timing has been hitherto set to be relatively early with respect to the engine revolution. In this connection, when the engine load is low, an amount of fuel is so small that $NO_x$, black smoke, etc. are less produced and the fuel injection timing may be set to be relatively early with respect to the engine revolution. It is however known that since the combustion temperature becomes very high during operation at a high speed and under a high load, $NO_x$ meaning NO and $NO_2$ together, which are said to be responsible for photochemical smog, tends to be produced. To reduce an amount of $NO_x$, therefore, it is advantageous to delay the fuel injection timing relatively with respect to the engine revolution. By so doing, optimum combustion is achieved.

Based on the above consideration, the injection timing is calculated in the second injection timing calculation block 50*d*. More specifically, the second injection timing calculation block 50*d* has set therein beforehand the relationship between the engine load torque and the injection timing with which when the engine load torque is small, the injection timing is relatively advanced with respect to the engine revolution, and as the engine load torque increases, the injection timing is delayed. The injection timing is calculated from that relationship.

Values representing the injection timings calculated in the first and second injection timing calculation blocks 50*c*, 50*d* are added in an adder 50*e*, and a resulting total value is output as target injection timing. A deviation of the target injection timing with respect to the detection signal from the lead angle sensor 53 (lead angle signal) is determined in a subtractor 50*f*, and based on the determined deviation, the injection timing command is calculated in a command value calculation block 50*g*. The injection timing command is converted into a control current which is output to the solenoid control valve 66 of the timer actuator 55.

Figure 7:
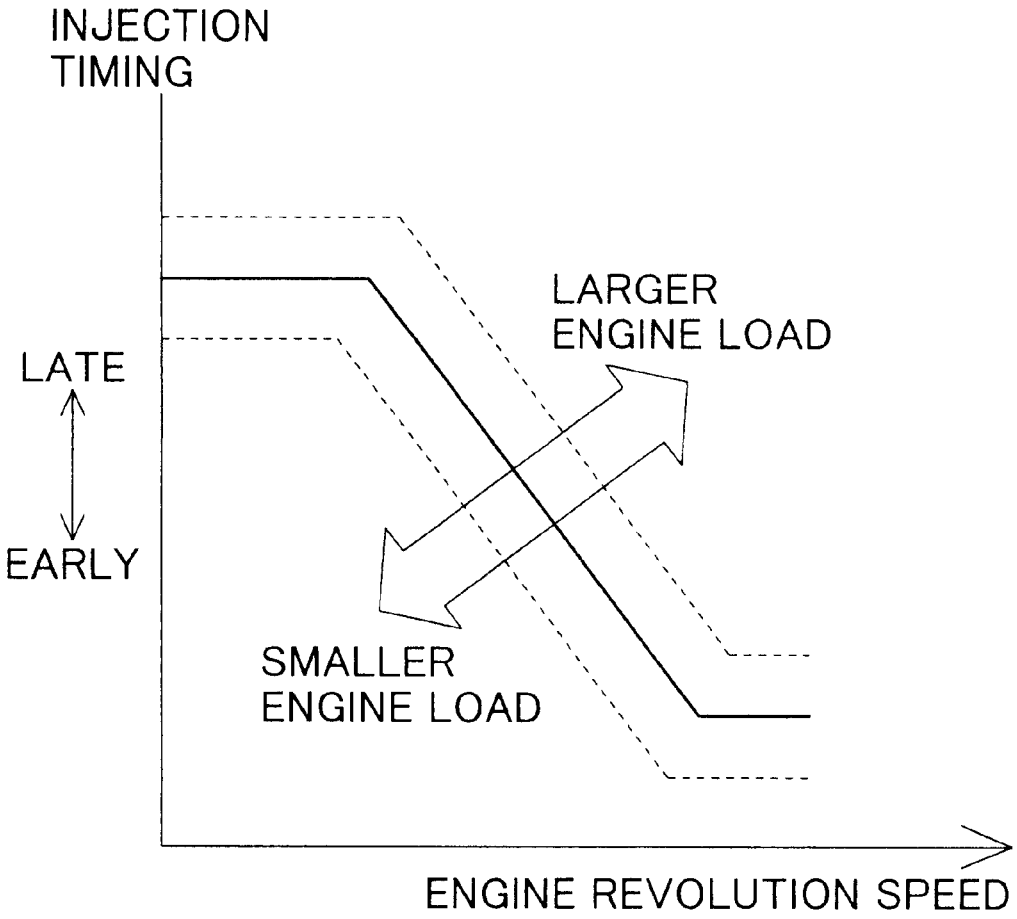
FIG. 7 is a graph showing the relationship among an engine revolution speed, an engine load and injection timing resulted under control made by the engine control system of the present invention.

FIG. 7 shows the relationship among the engine revolution speed, the engine load torque and the injection timing resulted when the timer actuator 55 is controlled in accordance with the injection timing command explained above. As seen from a graph of FIG. 7, the fuel injection timing is controlled to be advanced as the engine revolution speed rises, and to be delayed as the engine load torque increases.

With this embodiment thus constructed, since the fuel injection timing is controlled to be delayed as the engine load torque increases, exhaust gas can be prevented from being deteriorated due to the generation of $NO_x$.

Also, the pump controller 40 directly and accurately calculates the load imposed on the engine by calculating the load torques $T_{r1}$, $T_{r2}$ of the hydraulic pumps 1, 2 and then summing up the calculated load torques to determine the engine load torque, and the engine controller 50 calculates the target fuel injection timing by using the engine load torque. The target fuel injection timing depending on the engine load can be therefore determined accurately. In addition, even when the delivery rates and the delivery pressures of the hydraulic pumps 1, 2 are frequently changed and the total load of the hydraulic pumps, i.e., the engine load, is fluctuated, the fuel injection timing can be controlled with good response following the load fluctuation. As a result, it is possible to control the fuel injection timing optimally, achieve optimum combustion, improve the combustion efficiency and fuel consumption, make exhaust gas clean while suppressing the generation of $No_x$, and enhance the engine performance. Moreover, a temperature rise in the engine combustion chamber can be held down and the engine reliability can be improved.

Figure 8:
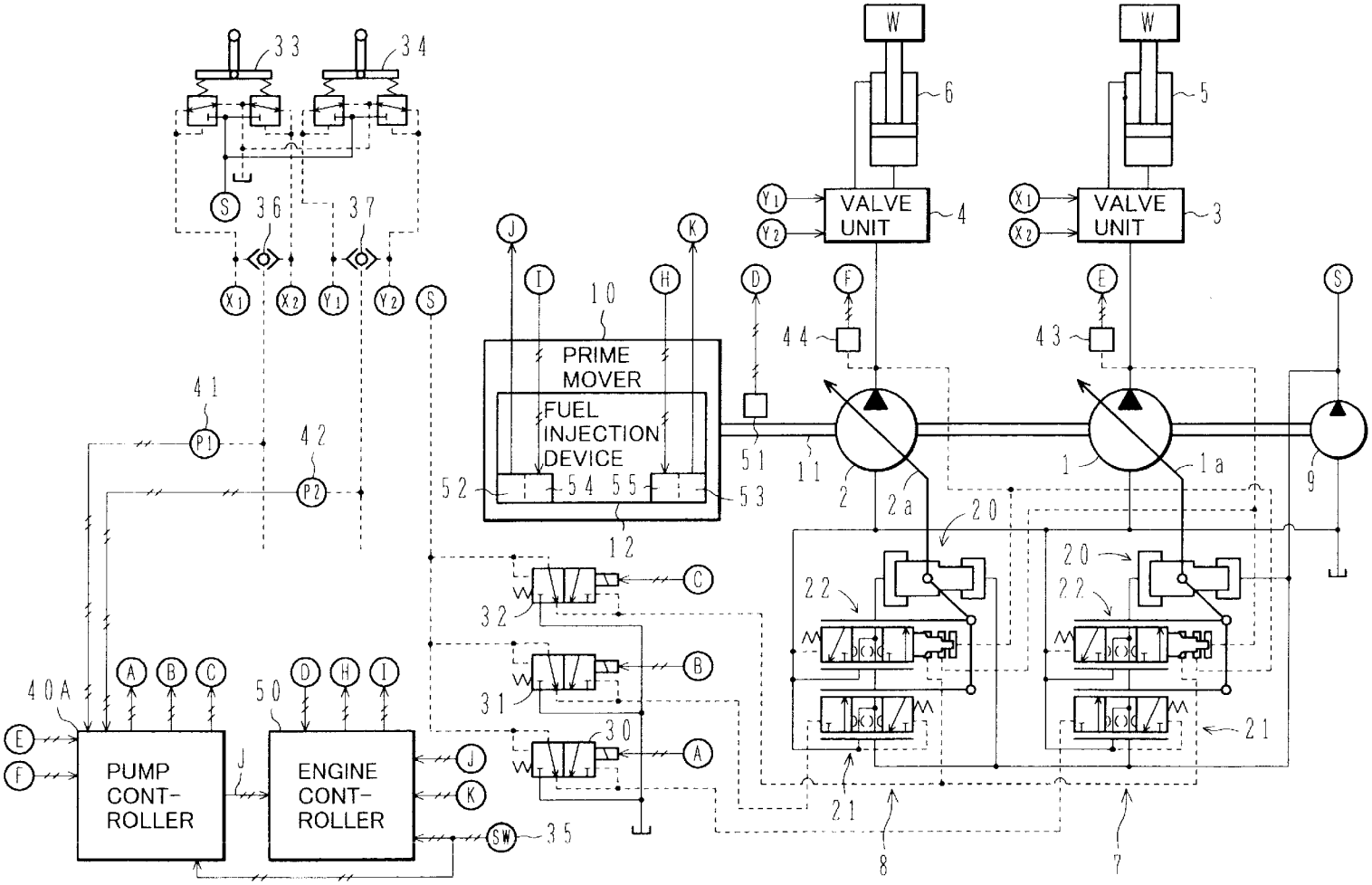
FIG. 8 is a diagram showing an entire configuration of an engine control system according to a second embodiment of the present invention along with a hydraulic circuit and a pump control system.
Figure 9:
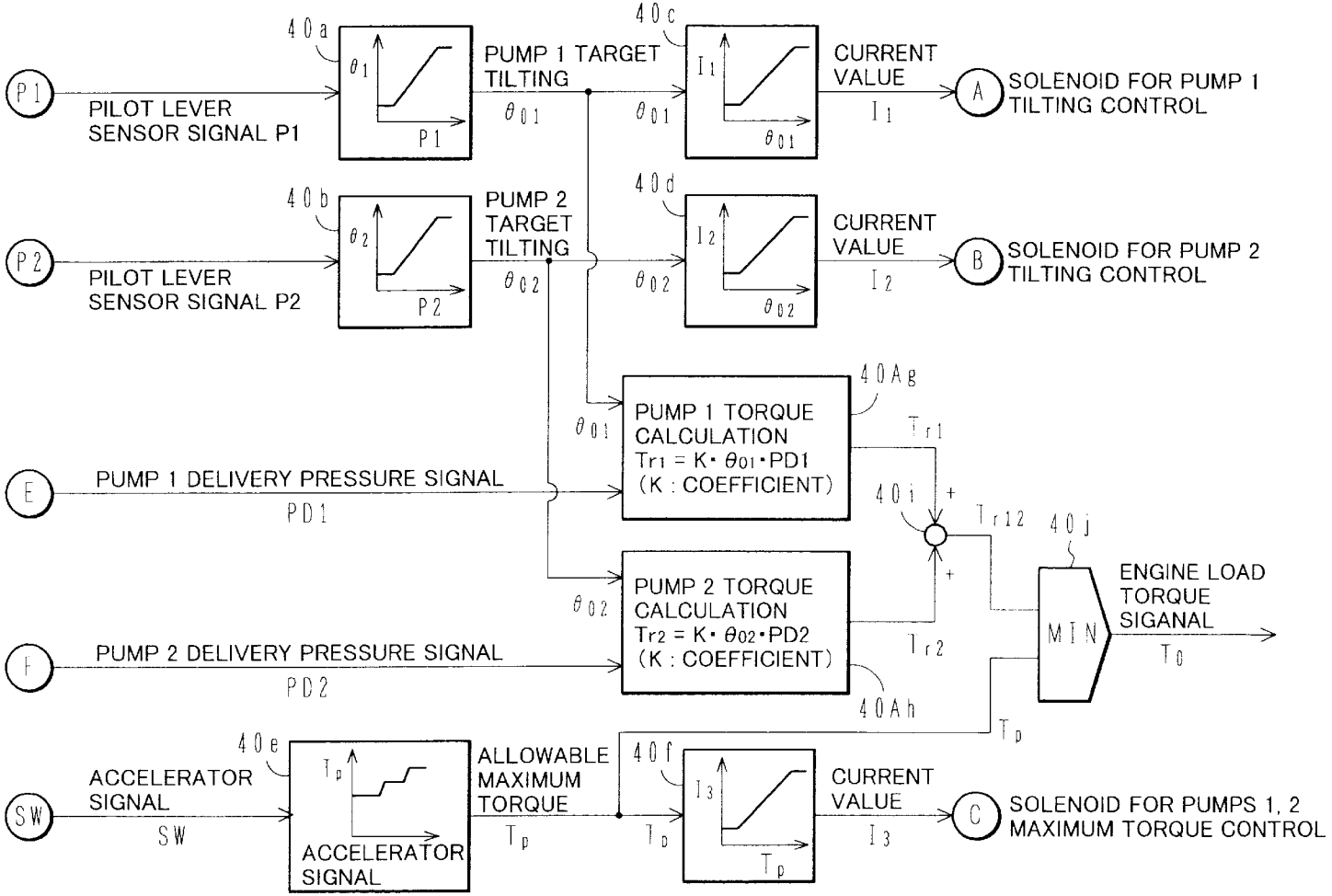
FIG. 9 is a functional block diagram showing a sequence of processing steps in a pump controller.

A second embodiment of the present invention will be explained with reference to FIGS. 8 and 9. In this embodiment, the load torque of the hydraulic pump is calculated by using a target pump tilting. In FIGS. 8 and 9, equivalent members and functions shown in FIGS. 1 and 4 are denoted by the same reference numerals.

Referring to FIG. 8, in this embodiment, there are no position sensors for detecting the tiltings of the swash plates 1*a*, 2*a* of the hydraulic pumps 1, 2, and a pump controller 40A receives only the detection signals from the pressure sensors 41, 42, 43, 44 and the accelerator signal from the accelerator operation input unit 35.

FIG. 9 shows a sequence of processing steps in the pump controller 40A in the form of a functional block diagram. In FIG. 9, respective processing steps in the target tilting calculation blocks 40*a*, 40*b*, the current value calculation blocks 40*c*, 40*d*, the maximum torque calculation block 40*e* and the current value converter 40*f* are the same as in the first embodiment shown in FIG. 4.

The target tilting $\theta_{01}$ of the hydraulic pump 1 calculated in the target tilting calculation block 40*a* and the detection signal from the pressure sensor 43 (delivery pressure signal $P_{D1}$ of the hydraulic pump 1) are input to a torque calculation block 40Ag, while the target tilting $\theta_{02}$ of the hydraulic pump 2 calculated in the target tilting calculation block 40*b* and the detection signal from the pressure sensor 44 (delivery pressure signal $P_{D2}$ of the hydraulic pump 2) are input to a torque calculation block 40 Ah. Load torques $T_{r1}$, $T_{r2}$ of the hydraulic pumps 1, 2 are calculated in those blocks 40Ag, 40Ah from the following formulae:

$$T_{r1}=K\cdot\theta_0\cdot P_{D1}$$

$$T_{r2}=K\cdot\theta_{01}\cdot P_{D2}\ (K\text{: constant})$$

The load torques $T_{r1}$, $T_{r2}$ are added in the adder 40*i* to determine a total $T_{r12}$ of the load torques of the hydraulic pumps 1, 2. The total pump load torque $T_{r12}$ is input, along with the allowable maximum torque $T_p$ calculated in the maximum torque calculation block 40*e*, to a minimum value selection block 40*j* which selects smaller one of the two torques input thereto.

As stated above, the tiltings of the hydraulic pumps 1, 2 are controlled by the regulators 7, 8 so that as the delivery pressures of the hydraulic pumps 1, 2 rise or as the target revolution speed input from the accelerator operation input unit 35 lowers, the maximum values of the delivery rates of the hydraulic pumps 1, 2 are reduced to keep the load of the hydraulic pump 1 from exceeding the output torque of the prime mover 10. More specifically, when the total load torque of the hydraulic pumps 1, 2 is going to exceed the allowable maximum torque $T_p$ in a condition where the target tiltings $\theta_{01}$, $\theta_{02}$ of the hydraulic pumps 1, 2 calculated in the target tilting calculation blocks 40*a*, 40*b* are increased, the tiltings of the hydraulic pumps 1, 2 are controlled not to exceed the respective target tiltings at that time. Thus, by selecting smaller one of the total pump load torque $T_{r12}$ and the allowable maximum torque $T_p$ in the minimum value selection block 40*j*, a value corresponding to the actual load torque of the hydraulic pumps 1, 2 is determined.

The load torque selected in the minimum value selection block 40*j* is output as an engine load torque signal $T_o$ to the engine controller 50.

With this embodiment, since the total load torque of the hydraulic pumps 1, 2 (engine load torque) is determined by using the target pump tiltings which represent values before the delivery rates of the hydraulic pumps 1, 2 are actually changed, response in injection timing control following fluctuation in the engine load caused by change in the delivery rates of the hydraulic pumps 1, 2 is further improved, the injection timing control can be performed with higher accuracy, and a further improvement of combustion can be achieved. In addition, since the position sensors for detecting the swash plate positions of the hydraulic pumps 1, 2 are dispensed with, the control system can be realized at a reduced cost.

It is a matter of course that while in the above embodiments the pump controller and the engine controller are provided separately from each other, these controllers may be constituted by a single controller.

Also, the delivery pressures of the hydraulic pumps 1, 2 are directly detected by the pressure sensors 43, 44 in the above embodiments. However, since there is a fixed relationship between the load pressures of the hydraulic actuators 5, 6 and the delivery pressures of the hydraulic pumps 1, 2, the delivery pressures of the hydraulic pumps 1, 2 may be obtained by detecting the load pressures of the hydraulic actuators 5, 6 and estimating them from the detected load pressures.

According to the present invention, as explained above, since the target fuel injection timing of the engine is determined by calculating the accurate load imposed on the engine, the fuel injection timing can be controlled with good response and high accuracy following load fluctuation of the engine. As a result, it is possible to control the fuel injection timing optimally, achieve optimum combustion, improve the combustion efficiency and fuel consumption, make exhaust gas clean while suppressing the generation of $No_x$, and enhance the engine performance. Moreover, a temperature rise in the engine combustion chamber can be held down and the engine reliability can be improved.

What is claimed is:

1. An engine control system for a construction machine comprising a diesel engine, at least one variable displacement hydraulic pump rotatively driven by said engine for driving a plurality of actuators, flow rate instruction means for instructing a delivery rate of said hydraulic pump, and an electronic fuel injection device for controlling an injected fuel amount in said engine, said electronic fuel injection device including a fuel injection timing control actuator for controlling fuel injection timing of said engine, wherein said engine control system comprises:

detecting means for detecting a status variable of said hydraulic pump, load calculating means for calculating a load of said hydraulic pump based on a value detected by said detecting means, and injection timing calculation control means for calculating target fuel injection timing of said engine based on a load of said hydraulic pump and operating said fuel injection timing control actuator.

2. An engine control system for a construction machine according to claim 1, wherein said detecting means comprises means for detecting a delivery pressure of said hydraulic pump and means for detecting a tilting position of said hydraulic pump, and wherein said load calculating means calculates the load of said hydraulic pump based on values detected by said delivery pressure detecting means and said tilting position detecting means.

3. An engine control system for a construction machine according to claim 1, wherein said detecting means comprises means for detecting a delivery pressure of said hydraulic pump, and wherein said load calculating means calculates the load of said hydraulic pump based on a value detected by said delivery pressure detecting means and a target tilting corresponding to the delivery rate of said hydraulic pump instructed by said flow rate instructing means.

4. An engine control system for a construction machine according to claim 1, wherein said injection timing calculation control means calculates said target fuel injection timing such that the fuel injecting timing of said engine is delayed as the load of said hydraulic pump increases.

5. An engine control system for a construction machine according to claim 1, further comprising means for detecting a rotational speed of said engine, wherein said injection timing calculation control means calculates target fuel injection timing based on the rotational speed of said engine, and combines that target fuel injection timing and said target fuel injection timing calculated based on the load of said hydraulic pump with each other to determine target fuel injection timing used to operate said fuel injection timing control actuator.

* * * * *